United States Patent [19]

Anderson et al.

[11] 4,184,301

[45] Jan. 22, 1980

[54] FASTENING DEVICE FOR WALL PANEL JOINTS

[75] Inventors: John W. Anderson, Bradford Woods; Raymond M. L. Ting, Pittsburgh, both of Pa.

[73] Assignee: H. H. Robertson Company, Pittsburgh, Pa.

[21] Appl. No.: 932,332

[22] Filed: Aug. 9, 1978

[30] Foreign Application Priority Data

Aug. 27, 1977 [ES] Spain ..... 230.785[U]

[51] Int. Cl.[2] ..... E04C 1/10; E04C 2/20; E04B 1/41; E04B 2/72

[52] U.S. Cl. ..... 52/478; 52/309.9; 52/512; 52/520; 52/595; 52/802

[58] Field of Search ..... 52/520, 542–552, 52/588, 595, 512, 309.2, 309.9, 478, 483, 489, 403, 782, 803, 804, 802

[56] References Cited

U.S. PATENT DOCUMENTS

| | | | |
|---|---|---|---|
| 3,535,844 | 10/1970 | Glaros | 52/309.9 X |
| 3,667,180 | 6/1972 | Tischuk | 52/309.2 |
| 3,714,747 | 2/1973 | Curran | 52/309.2 |
| 3,777,430 | 12/1973 | Tischuk | 52/309.9 |
| 3,797,190 | 3/1974 | Widdowson | 52/595 |
| 4,034,532 | 7/1977 | Reinwall, Jr. | 52/520 |
| 4,037,377 | 7/1977 | Howell et al. | 52/309.9 |
| 4,100,710 | 7/1978 | Kowallik | 52/309.9 |
| 4,104,840 | 8/1978 | Heintz et al. | 52/309.9 |
| 4,123,885 | 11/1978 | Scott | 52/483 |

*Primary Examiner*—Stephen J. Novosad
*Attorney, Agent, or Firm*—Harry B. Keck; George E. Manias

[57] ABSTRACT

A fastening device for securing adjacent double-skin foam-core wall panels to the structural framework of a building. One panel has a channel formed in the outer skin which extends laterally inwardly of a gap presented between the adjacent edges of the inner and outer skins. The adjacent panel has a tongue formed along the outer skin which is engaged in the channel. The fastening device includes a clip member and a fastener. The clip member has an edge strip engaged with the channel, a flange penetrating the core terminating proximate to the inner skin, and a medial strip connecting the edge strip to the flange. The medial strip is offset from the plane of the edge strip to provide space for the head of the fastener. The fastener extends through the medial strip, the core and the inner skin and secures the panel to the subgirt. The clip member may be mechanically connected with the channel to increase the suction load resistance of the joint.

6 Claims, 6 Drawing Figures

FASTENING DEVICE FOR WALL PANEL JOINTS

BACKGROUND OF THE INVENTION

1. Field of the Invention

This invention concerns joints between adjacent wall panels and more particularly to a fastening device for securing the adjacent wall panels at the joint to a structural member of a building framework.

2. Description of the Prior Art

Double-skin foam-core building panels are known in the art, wherein the inner and outer skins are laterally offset from each other to improve the thermal efficiency of the joint and to provide gaps along each side of the panel in which the foam core is exposed, and wherein mating connections are provided, one between the outer skins and one between the inner skins. See for example U.S. Pat. Nos. 3,535,844 (GLAROS); 3,667,180 (TISCHUK); 3,777,430 (TISCHUK). When these building panels are applied to a building framework, hidden fastening means is provided to secure the panel to the framework.

In a joint between two of the GLAROS panels, no space is provided between the confronting exposed core surfaces. Consequently, according to GLAROS, the core is routed out to provide space for the installation of a panel fastener. The space above the fastener is then filled. The GLAROS joint is structurally weak in that only the liner sheet of one panel is positively secured to the subgirt.

In a joint between two of the panels of either TISCHUK '180 or TISCHUK '430, a space is provided between the confronting exposed core surfaces. TISCHUK provides a clip and fastener arrangement which positively connects the inner and outer skins; and positively secures the inner skin to the subgirt.

SUMMARY OF THE INVENTION

The present invention constitutes an improvement over the GLAROS type panel. That is, a panel wherein the inner and outer skins are laterally offset from each other and wherein mating connections are provided, one between the outer skins of adjacent panels and one between the inner skins of adjacent panels, and wherein no space is provided between the confronting exposed core surfaces.

The principal object of the invention is to provide an improved fastening device which includes a clip member positioned between the overlapped and interlocked longitudinal edges of adjacent wall panels and a fastener which extends through the clip member and one longitudinal side of the panel, for the purpose of rigidly securing the adjacent wall panels to a structural member of a building framework without degrading the weather seal and the vapor seal provided at the interlocked edges of the adjacent wall panels.

The fastening device of the invention is particularly suited for use in joints between adjacent first and second wall panels each of which includes inner and outer skins which are laterally offset relative to each other and which present first and second gaps along opposite longitudinal sides of the panel, and which further includes an insulating core which connects the inner skin in shear-transfer relation to the outer skin and which is exposed at the first and second gaps.

The joint is characterized in that the first panel has a channel formed in the outer skin thereof which extends laterally inwardly of the first gap, and in that the second panel has a tongue formed in the outer skin which extends laterally outwardly of the second gap into the channel of the first panel thereby to provide a positive mechanical connection between the outer skins. The fastening device of the invention includes a clip member and a fastener. The clip member is presented at the first gap and is characterized in having an edge strip extending into the channel; and having a flange which extends into the insulating core at the first gap, presenting a remote end adjacent to the inner skin; and having a medial strip connecting the flange to the edge strip which is generally parallel with the edge strip but which is disposed between the plane of the edge strip and the plane of the inner skin. The fastener which extends through the medial strip, the core and the inner skin secures the first panel to a structural member.

The joint is futher characterized in that the head of the fastener resides between the tongue of the first panel and the edge strip of the clip member.

The joint is still further characterized in that the clip member is mechanically connected with the channel of the outer skin for the purpose of improving the suction load capacity of the joint of this invention.

DESCRIPTION OF THE PREFERRED EMBODIMENT(S)

Figure 1:
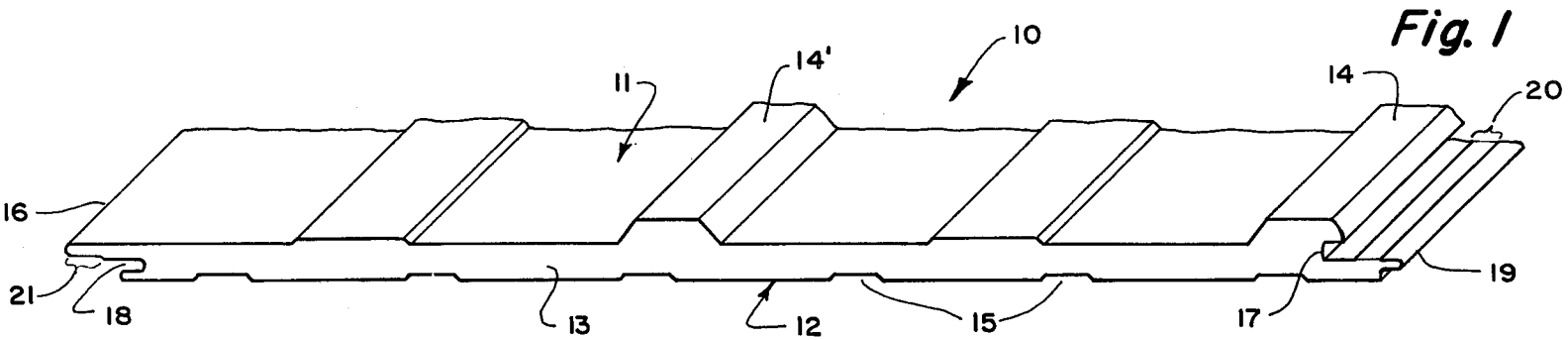
FIG. 1 is a fragmentary isometric view of a composite wall panel.

FIG. 1 illustrates a composite wall panel 10 assembled from outer and inner skins 11, 12 and an insulating core 13 which connects the outer skin 11 in shear-transferring relation to the inner skin 12. The inner and outer skins 11, 12 may be formed from sheet metal having a nominal thickness of about 0.50 millimeter. The skins 11, 12 may have an embossed pattern and may have a decorative coating applied to the exterior surfaces thereof. The insulating core 13 may comprise any suitable insulating material. Preferably, the insulating core 13 comprises a foamed plastic material, such as polyurethane which is foamed-in-place between the skins 11, 12. To improve the span capabilities of the wall panel 10, the outer skin 11 may be provided with upstanding ribs 14, 14'. The remaining portions of the outer skin 11 may be profiled, as illustrated in FIG. 1. The inner skin 12 may be provided with spaced depressions 15. The profiling of the skins 11, 12 helps eliminate waviness thereby improving the appearance of the exposed surfaces thereof.

First and second mating elements 16, 17 are provided along the opposite longitudinal edges of the outer skin 11. Third and fourth mating elements 18, 19 are provided along the opposite longitudinal edges of the inner skin 12.

Figure 2:
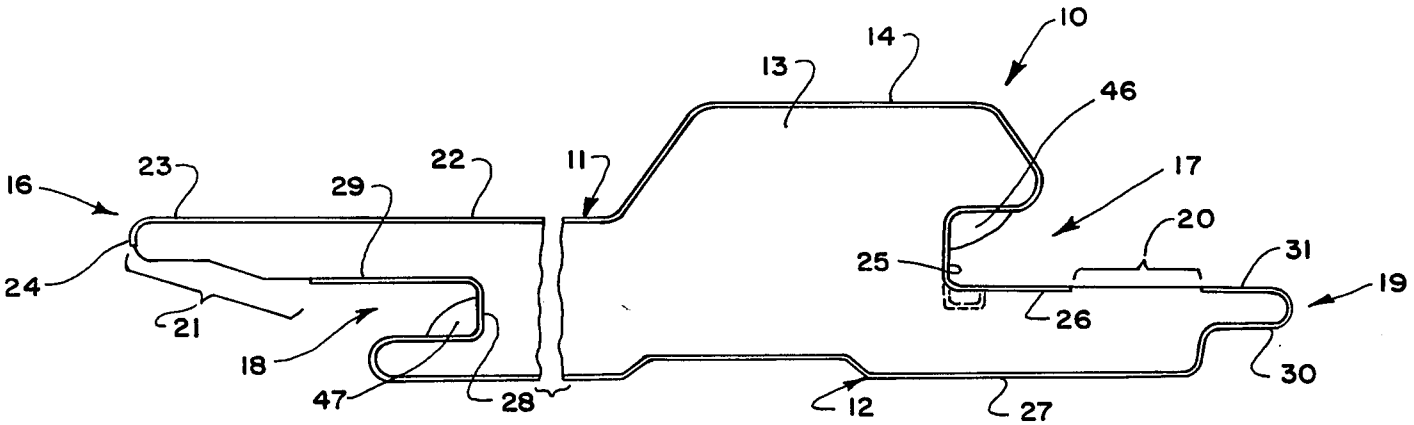
FIG. 2 is a broken end view of the wall panel of FIG. 1, illustrating the complementary mating elements formed in the inner and outer skins thereof.

Referring to FIG. 2, the outer and inner skins 11, 12 are laterally offset relative to each other to improve the thermal efficiency of the joint. The wall panel 10 presents first and second gaps 20, 21 at which the insulating core 13 is exposed. The wall panel 10 is thereby adapted to be secured to a structural support by the fastening device of this invention which is positioned at the first gap 20 and which is hidden from view. The outer skin 11 includes a profiled outer web 22. The first mating element 16 is constituted by an edge portion 23 having a down-turned flange 24 which defines one edge of the second gap 21. The second mating element 17 is constituted by an enlarged channel 25 extending laterally inwardly of the rib 14 and including a sidewall 26 defining one edge of the first gap 20. The inner skin 12 includes a profiled inner web 27. The third mating element 18 is constituted by a second channel or groove 28 which extends laterally inwardly of the second gap 21 and which includes a sidewall 29 defining the opposite edge of the second gap 21. It is preferred that the down-turned flange 24 terminate at a level above that of the channel 29 to provide space within the enlarged channel 25 for the introduction of the fastening device of this invention. The fourth mating element 19 is constituted by a tongue 30 having a sidewall 31 which extends inwardly toward and defines the opposite edge of the first gap 20. Beads 46 and 47 of a resilient sealing material may be provided in and along the length of the channel 25 and the groove 28 for the purpose of establishing weather-tight seal between the outer skins of adjacent panels and a vapor seal between the inner skins of adjacent panels.

Figure 3:
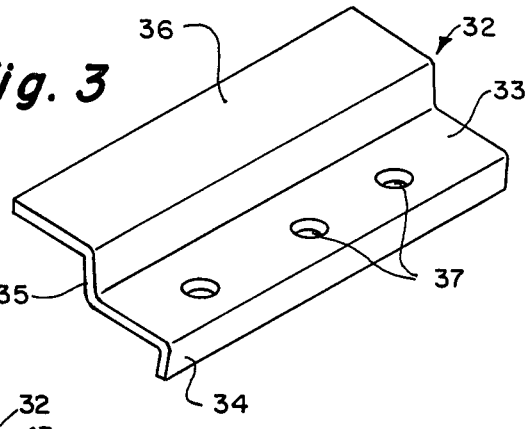
FIG. 3 is an isometric view of a clip member of this invention.

Referring to FIG. 3, the present fastening device includes a clip member 32 comprising a medial strip 33 having a flange 34 extending downwardly from one edge thereof and having a web 35 which extends upwardly from the opposite edge thereof. An edge strip 36 extends outwardly from the web 35 and is generally parallel with but upwardly offset from the medial strip 33. One or more openings 37 are provided in the medial strip 33 to receive fasteners.

Figure 4:
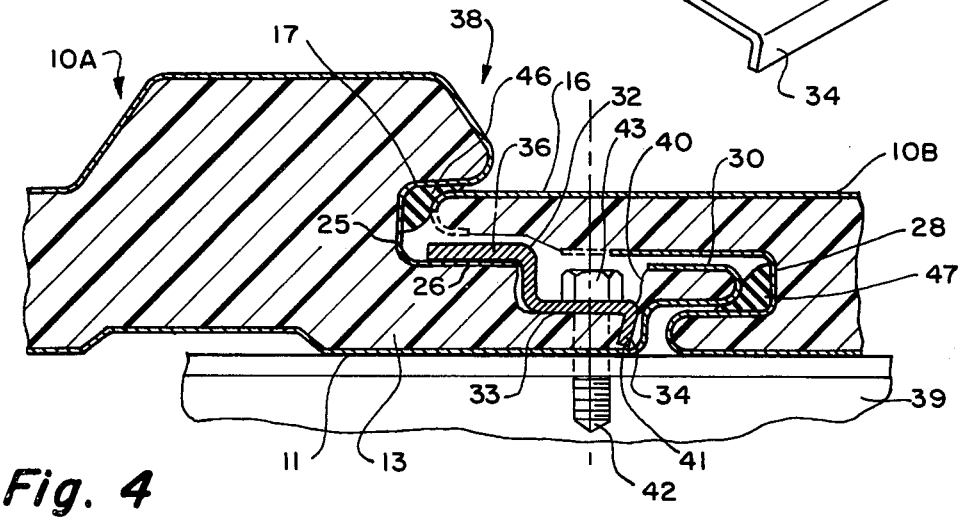
FIG. 4 is a fragmentary cross-sectional view of a joint between adjacent wall panels which incorporates the clip member of FIG. 3.

FIG. 4 illustrates a joint 38 formed between adjacent wall panels 10A, 10B which are secured to a structural member 39 of a building framework by the fastening device of this invention. When the clip member 32 is installed, the edge strip 36 extends into the channel 25 and is engaged over the sidewall 26. The medial strip 33 is disposed within a cavity 40 formed in the insulating core 30 at the first gap. The flange 34 penetrates the insulating core 13 and has a remote end 41 positioned adjacent to the inner skin 27. A fastener 42 which extends through the medial strip 33, the insulating core 13 and the inner skin 11 secures the first panel 10A to the structural member 39. The second panel 10B is then installed. It will be observed that the head 43 of the fastener 42 resides between the tongue 16 of the second panel 10B and the edge strip 36. When the second panel 10B is erected, a weather-tight seal and a vapor seal are provided by the sealant beads 46, 47.

Figure 5:
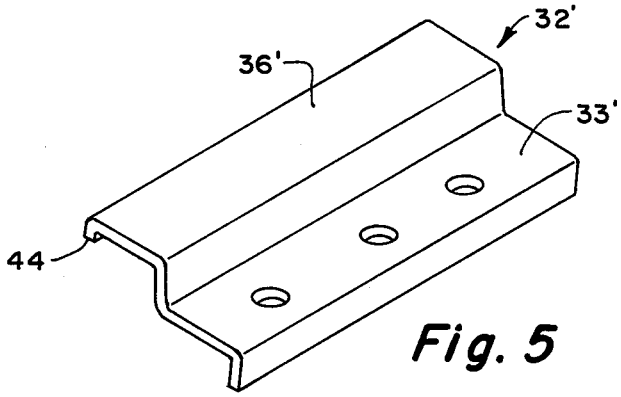
FIG. 5 is an isometric view of an alternative clip member.
Figure 6:
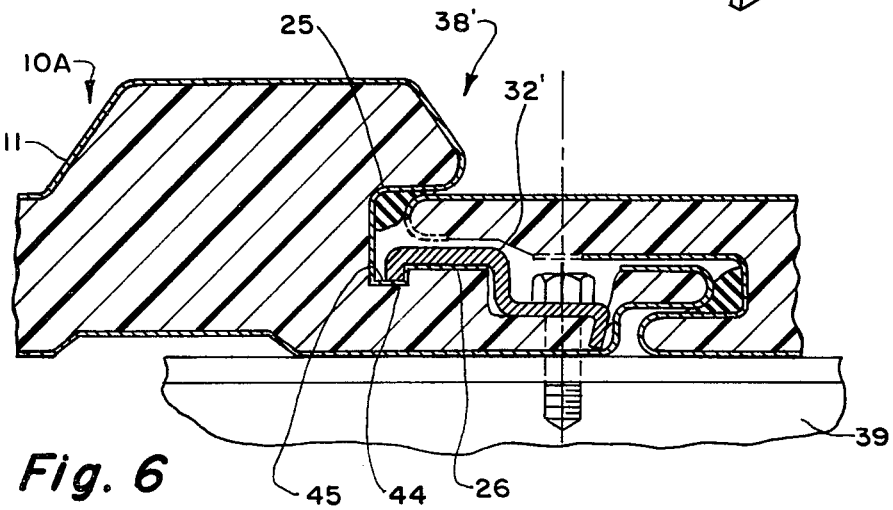
FIG. 6 is a cross-sectional view, similar to FIG. 4, illustrating a joint between adjacent panels which incorporates the clip member of FIG. 5.

To improve the suction load capacity of the joint 38, connecting means is provided for mechanically connecting the clip member preferably with the channel 25. The desired mechanical connection may be achieved by providing a clip member 32' (FIG. 5) having a second flange 44 which, as shown in FIG. 6, engages a recess 45 formed in the channel 25. To simplify manufacturing of the clip member 32', the second flange 44 preferably is formed along that edge of the edge strip 36' which is remote from the medial strip 33'. The location of the recess 45 along the width of the sidewall 26 is determined by the amount of interlock mechanical connection required to resist anticipated stresses.

We claim:

1. A joint between adjacent first and second wall panels wherein each panel includes outer and inner skins which are laterally offset relative to each other and which present first and second gaps along opposite longitudinal sides of the panel, and an insulating core which connects the inner skin in shear-transferring relation to the outer skin and which is exposed at the first and second gaps; said joint comprising: the first panel having a channel formed in the outer skin and extending laterally inwardly of said first gap; a clip member presented at the first gap and including an edge strip extending into said channel, a flange extending into said insulating core at said first gap and presenting a remote end adjacent to said inner skin, and a medial strip connecting said flange to said edge strip, said medial strip being generally parallel with said edge strip and disposed between the plane of said edge strip and the plane of said inner skin, and connecting means mechanically connecting said clip to said channel; a fastener extending through said medial strip, said core, and said inner skin and securing the first panel to a structural member; and the second panel having a tongue formed in the outer skin extending laterally outwardly of said second gap, over said edge strip and into said channel of the first panel.

2. The joint as defined in claim 1 wherein the head of said fastener resides between said tongue of the second panel and said edge strip.

3. The joint as defined in claim 1 wherein said connecting means comprises a recess formed in said channel and penetrating said insulating core, and a second flange extending from said edge strip and mechanically engaged in the recess.

4. The joint as defined in claim 3 wherein said channel of the first panel has a sidewall engaged behind said edge strip, and said recess is formed in said sidewall.

5. The joint as defined in claim 3 wherein said second flange is formed along that edge of said edge strip which is remote from said medial strip.

6. The joint as defined in claim 1 wherein the first panel has a tongue formed in the inner skin which extends laterally outwardly of said first gap, and the second panel has a complementary groove formed in the inner skin which receives said tongue of the first panel.

* * * * *